US008533962B1

(12) United States Patent
Laube

(10) Patent No.: US 8,533,962 B1
(45) Date of Patent: Sep. 17, 2013

(54) CLIPPER LEVER

(76) Inventor: Kim E. Laube, Thousand Oaks, CA (US)

( * ) Notice: Subject to any disclaimer, the term of this patent is extended or adjusted under 35 U.S.C. 154(b) by 409 days.

(21) Appl. No.: 12/319,499

(22) Filed: Jan. 7, 2009

(51) Int. Cl.
*B26B 19/12* (2006.01)

(52) U.S. Cl.
USPC ..... 30/210; 30/220; 30/43.91

(58) Field of Classification Search
USPC ..... 30/43.91–43.92, 44–45, 210, 216–220
See application file for complete search history.

(56) References Cited

U.S. PATENT DOCUMENTS 4,723,362 A * 2/1988 Boerger ..... 30/218
4,813,133 A * 3/1989 Locke et al. ..... 30/215
5,259,116 A 11/1993 Laube
2005/0060893 A1* 3/2005 Comminges ..... 30/216
2006/0064878 A1* 3/2006 Melton et al. ..... 30/216
2008/0263871 A1 10/2008 Liao
2010/0031514 A1* 2/2010 Kohn ..... 30/216

OTHER PUBLICATIONS

U.S. Appl. No. 11/137,250, Laube.

* cited by examiner

*Primary Examiner* — Phong Nguyen
(74) *Attorney, Agent, or Firm* — Dennis W. Beech

(57) ABSTRACT

The present invention may be used oscillate a movable blade of a clipper. A lever may be a drive finger attached to a rotator member and a motor lever arm attached to the rotator member approximately opposite the drive finger along a longitudinal axis. A rotator bearing cavity of generally cylindrical shape may be formed in the rotator member and may be sized for insertion of a rotator bearing. A bottom wall of the rotator bearing cavity may have an aperture sized to allow fluid to flow through the aperture adjacent a lever shaft inserted through the rotator bearing and the aperture. A motor end of the motor lever arm may have a motor end cavity therein with two opposed spaced apart side walls.

3 Claims, 3 Drawing Sheets

CLIPPER LEVER

BACKGROUND OF THE INVENTION

This invention relates to devices for clipping hair on animals and humans, for clipping fabrics such as carpets and other products that may be groomed using cutting clippers that use a lever or engagement element between the clipper motor and the blades to move the blades. The new lever may have a rotator bearing or roller bearing positioned in a rotator member cavity to facilitate lubrication and a motor lever arm end shaped to retain bearing lubrication and allow oscillating motion adjacent a motor shaft drive end.

Clipper levers also known as engagement elements are often used as part of the drive apparatus to transfer clipper electric motor power to an oscillating or reciprocating motion for movement of cutting blades for use in cutting hair on animals and humans. The lever may be fabricated from metal, plastic, composite material and the like. An often used material is plastic that may be molded as a lever. The levers may not have a roller bearing positioned in the central portion of the lever that may have an aperture for rotatable positioning on a lever shaft or pins. While bushings may be known for lever pins or shafts, the use of these elements may allow rapid wearing of the pin and rotating lever. There may also be no structure to aid in lubricating or maintaining lubricant in a central rotator member. Poor retention of lubricant for a bearing in a motor end cavity may also cause problems with clipper levers as a cavity for receipt of a motor drive shaft bearing may allow lubricant to escape.

SUMMARY OF THE INVENTION

The present invention is directed to devices that may oscillate a movable blade of a clipper. A lever may be a drive finger attached to a rotator member and a motor lever arm attached to the rotator member approximately opposite the drive finger along a longitudinal axis. A rotator bearing cavity of generally cylindrical shape may be formed in the rotator member and may be sized for insertion of a rotator bearing. A bottom wall of the rotator bearing cavity may have an aperture sized to allow fluid to flow through the aperture adjacent a lever shaft inserted through the rotator bearing and the aperture. A motor end of the motor lever arm may have a motor end cavity therein with two opposed spaced apart side walls.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
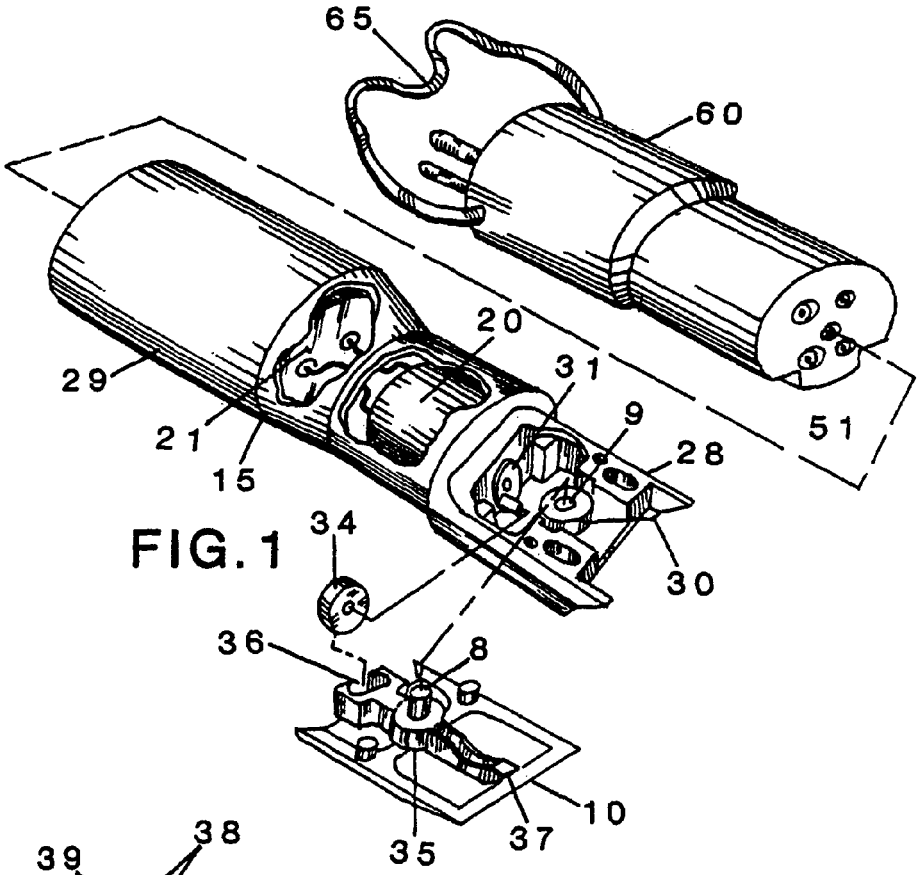
FIG. 1 illustrates a perspective partially disassembled top view of a clipper and bottom view of a lever cover assembly according to an embodiment of the invention.
Figure 2:
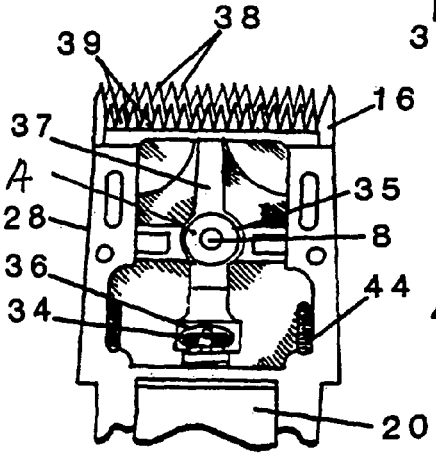
FIG. 2 illustrates a plan view of the lever and blade portion of a clipper according to an embodiment of the invention.
Figure 3:
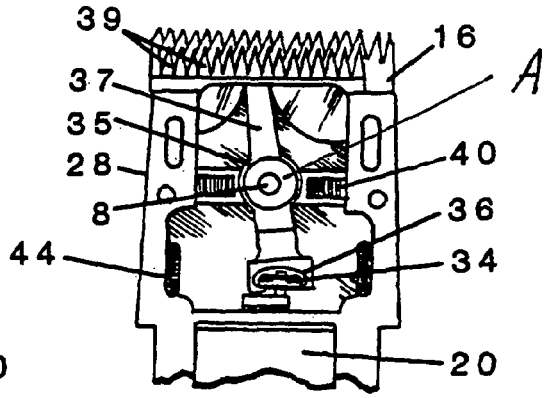
FIG. 3 illustrates a plan view of the lever and blade portion of a clipper with a blade moved to the left according to an embodiment of the invention.
Figure 4:
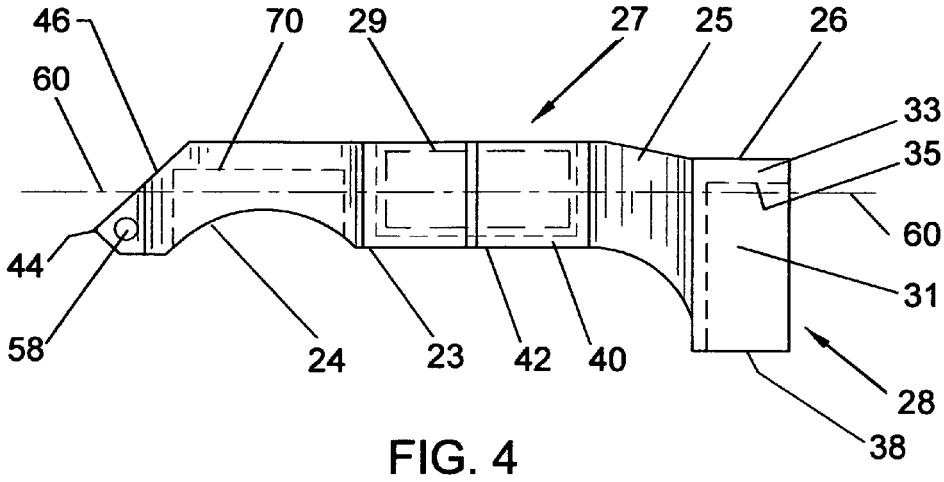
FIG. 4 illustrates a side view of a lever according to an embodiment of the invention.
Figure 5:
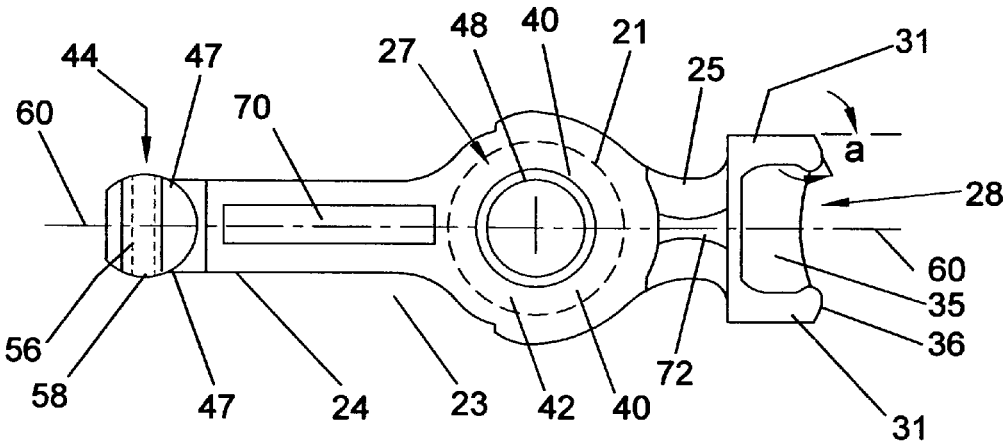
FIG. 5 illustrates a bottom plan view of a lever according to an embodiment of the invention.
Figure 6:
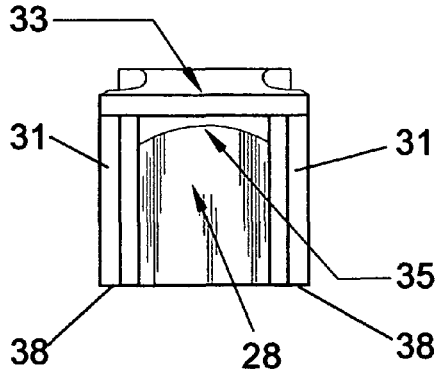
FIG. 6 illustrates a motor end view of a lever according to an embodiment of the invention.
Figure 7:
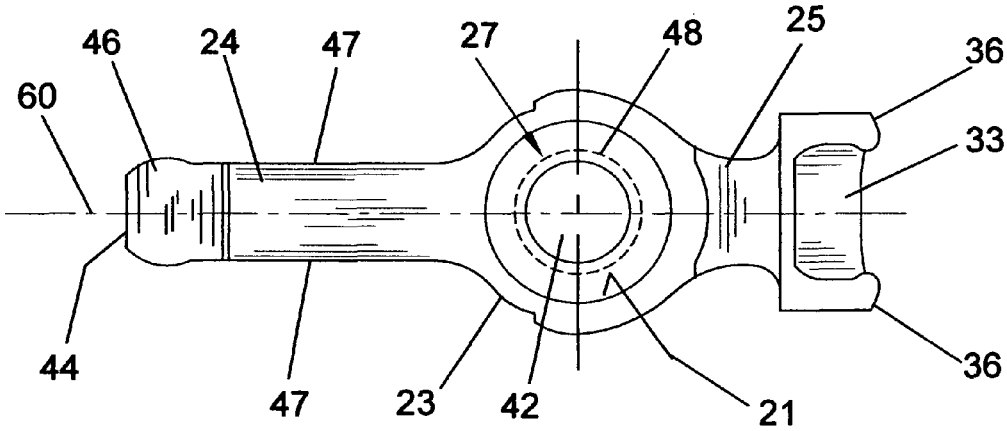
FIG. 7 illustrates a top plan view of a lever according to an embodiment of the invention.

Referring to FIGS. 1 through 3, a clipper 10 may have an electric motor 12 and a blade drive apparatus 14 that may have a front lower portion 16 and a lever cover 18. A lever 20 may be rotatably mounted on a lever shaft 22. The lever 20 may have a drive finger 24 and motor end 26. The motor end 26 may have a motor end cavity 28 for receipt of a motor end bearing 30 that may engage a motor shaft drive end 32 that may have an off center shaft 34 to translate motor shaft rotation to an orthogonal lever shaft to oscillate a blade. The lever 20 may be viewed in a centered position in FIG. 2 and a left position in FIG. 3. The lever 20 is engaged at the drive finger 24 with the movable blade 50 in a drive recess slot 54 to oscillate the movable blade 50 back and forth relative to the fixed blade 52 for the cutting action. While a particular eccentric motor shaft drive end 32 has been illustrated, this is made merely for the purpose of illustrating the general principals of a blade drive mechanism to oscillate a cutting blade for a clipper. Any motor shaft drive and blade drive mechanism using a lever may benefit from use of a support insert.

Referring to FIGS. 1 through 7, the lever 20 may have the drive finger 24 attached to a rotator member 23 and a motor lever arm 25 attached to the rotator 23 generally opposite the drive finger 24 along a longitudinal axis 60. There may be a rotator bearing cavity 27 of generally cylindrical shape formed in the rotator member 23 to form a cylindrical wall 21 with an open top and a bottom wall 40. A rotator bearing 29 may be positioned in the rotator bearing cavity 27 and may be retained by a friction fit at the bearing 29 outside circumference. The rotator bearing 29 may be of the roller ball type with an inside and an outside race with ball bearings.

The bottom wall 40 may have an aperture 42 centrally formed therethrough and the aperture 42 may be sized for insertion of a lever shaft 22. The aperture 42 may have a diameter larger than the diameter of the lever shaft 22 to allow fluid lubricant or oil to flow through the aperture adjacent to the lever shaft 22. The aperture 42 may have an approximate diameter between 0.062 inches and 1.062 inches that may depend on the size of the blade drive aperture 14. A general purpose hair clipper drive may use an approximately 0.255 inches diameter aperture.

The aperture 42 at its center may be spaced apart from the lever tip end 44 a distance of approximately between 0.125 and 1.950 inches. A general purpose hair clipper drive may use a distance of approximately 1.210 inches. The aperture 42 center may also be spaced apart from the motor lever arm 25 motor end 26 back edge 36 a distance of approximately between 0.125 inches and 1.950 inches depending on clipper size. A general purpose hair clipper drive may use an approximately 0.810 inches distance.

The bottom wall 40 of the rotator bearing cavity 27 in a lower or outer surface may have an annular groove 48 formed adjacent to the aperture 42. The annular groove 48 may be sized to overlay openings of one or more lubrication passages 62 that may be in a rotator mount 64 in the front lower portion 16.

The motor lever arm 25 may have a motor end 26 with a motor end cavity 28 that may have two opposed spaced apart side walls 31. Each side wall 31 at a back edge 36 may be angled at most 80 degrees relative to the longitudinal axis 60, as best viewed in FIG. 5, reference angle a. This may allow the oscillating motion of the motor end 26 to occur as close as possible to the motor shaft drive end 32 as compared to an edge 36 that might be a right angle edge.

The motor end cavity 28 may have a top wall 33 that may have a concave arch shape. The interior surface 35 of the top wall 33 may have a concave arch shape. This may allow the top wall 33 to be positioned as close as possible to the area of travel of the motor end bearing 30 when the motor shaft drive end 32 may be rotating. This top wall 33 may aid in retaining lubricant for the motor end bearing 30.

The motor end 26 may be sized for the motor end cavity 28 to receive the motor end bearing 30 to maintain continuous contact of the bearing 30 with the interior of the side walls 31 as the bearing 30 rotatably positioned on an off center shaft 34 attached to the motor shaft drive end 32 may be rotated. This may reduce or eliminate jamming or jerking at each end of the reciprocating cycle. The distance between the side walls 31 outside surfaces may be approximately between 0.062 and 2.875 inches. The motor end cavity 28 may have a height between the bottom edges 38 of the side walls 31 and the interior surface 35 of approximately between 0.025 and 2.625 inches. A general purpose hair clipper drive may have a side wall 31 distance of approximately 0.600 inches and a motor end cavity 28 height of approximately 0.585 inches.

The motor end 26 may be relatively larger than the motor lever arm 25 and the motor lever arm 25 may be attached to the motor end 26 by a radiused material structure to improve the strength of the juncture. The motor lever arm 25 may have a slot 72 formed in a lower portion between the rotator member 23 and the motor end 26. This may form two parallel rib or beam like members that may reduce flexing or wrenching under stressful torque conditions, and may improve heat transfer from the lever arm 25.

The drive finger 24 may also have an elongated slot 70 formed in a lower portion between the rotator member 23 and the lever tip end 44. This may form two parallel rib or beam like members that may reduce flexing or wrenching under stressful torque conditions, and may improve heat transfer from the drive finger 24. The lever tip end 44 may have a top surface 46 that may have a slope angle relative to the longitudinal axis 60 of between approximately 1 degree and 121 degrees. An angle of approximately 45 degrees has been found useful in some general purpose hair clipper drives, but the angle may depend on the clipper drive apparatus structure.

The lever tip end 44 may have a transverse thickness of approximately between 0.025 and 0.625 inches. A general purpose hair clipper drive may use a thickness of approximately 0.290 inches. There may also be a generally transverse lever cavity 56 formed in the drive finger 24 adjacent the lever tip end 44. The lever cavity 56 may be positioned such that the ends of a rod 58 positioned in the lever cavity 56 will be located to engage a clipper blade 50 drive finger slot 54. The rod 58 may be formed of a rigid, durable material to aid in reducing wear of the drive finger 24 as it is oscillated to move the clipper blade 50.

The lever shaft 22 may be attached to and extend outwardly from a lever cover 18. A rotator cup 66 may be annularly positioned around the lever shaft 22 and may be attached to the lever cover 18, as best viewed in FIG. 1. The wall of the rotator cup 66 may have one or more wall slots 68. The rotator cup 66 may aid in lubricating and heat dissipation for the rotator bearing 29.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for oscillating a movable blade of a clipper comprising:

a lever having a drive finger attached to a rotator member and a motor lever arm attached to said rotator member approximately opposite said drive finger along a longitudinal axis;

a rotator bearing cavity of generally cylindrical shape formed in said rotator member with a rotator bearing disposed therein;

a bottom wall of said rotator bearing cavity has an aperture centrally disposed therein and said aperture sized to allow fluid to flow through said aperture adjacent a lever shaft inserted through said rotator bearing and said aperture;

a motor end of said motor lever arm has a motor end cavity therein with two opposed spaced apart side walls; and said bottom wall has an annular groove formed in a lower surface adjacent said aperture sized to overlay a lubrication passage opening in a rotator mount in a front lower portion.

2. A device for oscillating a movable blade of a clipper comprising:

a lever having a drive finger attached to a rotator member and a motor lever arm attached to said rotator member approximately opposite said drive finger along a longitudinal axis;

a rotator bearing cavity of generally cylindrical shape formed in said rotator member with a rotator bearing disposed therein;

a bottom wall of said rotator bearing cavity has an aperture centrally disposed therein and said aperture sized to allow fluid to flow through said aperture adjacent a lever shaft inserted through said rotator bearing and said aperture;

a motor end of said motor lever arm has a motor end cavity therein with two opposed spaced apart side walls; and said lever shaft is attached to and extends outwardly from a lever cover with a rotator cup annularly disposed around said lever shaft and attached to said lever cover; and said lever cover disposable on and attachable to said front lower portion.

3. The apparatus as in claim 2 wherein said rotator cup has a wall slot.

* * * * *